US007712416B2

(12) United States Patent
Pratt et al.

(10) Patent No.: US 7,712,416 B2
(45) Date of Patent: May 11, 2010

(54) APPARATUS AND METHOD FOR PENETRATING OILBEARING SANDY FORMATIONS, REDUCING SKIN DAMAGE AND REDUCING HYDROCARBON VISCOSITY

(75) Inventors: Dan W. Pratt, Fort Worth, TX (US); Mammohan Singh Chawla, College Park, MD (US)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 12/357,303

(22) Filed: Jan. 21, 2009

(65) Prior Publication Data

US 2009/0235836 A1 Sep. 24, 2009

Related U.S. Application Data

(63) Continuation of application No. 10/691,802, filed on Oct. 22, 2003, now abandoned.

(51) Int. Cl.
*F42B 1/024* (2006.01)
*F42B 1/028* (2006.01)
*F42B 1/032* (2006.01)

(52) U.S. Cl. ..... 102/307; 102/476

(58) Field of Classification Search ..... 102/476, 102/306–310

See application file for complete search history.

(56) References Cited

U.S. PATENT DOCUMENTS

| | | | |
|---|---|---|---|
| 2,972,948 | A | 2/1961 | Kray |
| 4,922,825 | A | 5/1990 | Aubry et al. |
| 5,033,387 | A | 7/1991 | Lips |
| 5,155,296 | A | 10/1992 | Michaluk |
| 5,744,747 | A | 4/1998 | Renaud-Bezot et al. |
| 5,792,977 | A | 8/1998 | Chawla |
| 5,797,464 | A | 8/1998 | Pratt et al. |
| 6,021,714 | A | 2/2000 | Grove et al. |
| 6,186,070 | B1 | 2/2001 | Fong et al. |
| 6,250,229 | B1 | 6/2001 | Kerdraon et al. |

(Continued)

FOREIGN PATENT DOCUMENTS

| | | | |
|---|---|---|---|
| AU | 9859458 | A | 9/1998 |

(Continued)

*Primary Examiner*—James S Bergin
(74) *Attorney, Agent, or Firm*—Mossman, Kumar & Tyler, P.C.

(57) ABSTRACT

A shaped charge and a method of using such to provide for large and effective perforations in oil bearing sandy formations while causing minimal disturbance to the formation porosity is described. This shaped charge uses a low-density liner having a filler material that is enclosed by outer walls made, preferably, of plastic or polyester. The filler material is preferably a powdered metal or a granulated substance, which is left largely unconsolidated. The preferred filler material is aluminum powder, or aluminum particles, that are coated with an oxidizing substance, such as TEFLON®, permitting a secondary detonation reaction inside the formation following jet penetration. The filled liner is also provided with a metal cap to aid penetration of the gun scallops, the surrounding borehole casing and the cement sheath. The metal cap forms the leading portion of the jet, during detonation. The remaining portion of the jet is formed from the low-density filler material, thereby resulting in a more particulated jet. The jet results in less compression around the perforation tunnel and less skin damage to the proximal end of the perforation tunnel.

11 Claims, 3 Drawing Sheets

U.S. PATENT DOCUMENTS

| | | | | |
|---|---|---|---|---|
| 6,308,634 | B1 | 10/2001 | Fong | |
| 6,510,796 | B2 | 1/2003 | Mayseless et al. | |
| 6,530,326 | B1 | 3/2003 | Wendt, Jr. et al. | |
| 6,588,344 | B2 | 7/2003 | Clark et al. | |
| 6,786,157 | B1 * | 9/2004 | Powell | 102/476 |
| 2003/0037692 | A1 * | 2/2003 | Liu | 102/301 |

FOREIGN PATENT DOCUMENTS

| | | | |
|---|---|---|---|
| DE | 1136920 | B | 9/1962 |
| DE | 19630339 | A1 | 1/1997 |
| DE | 10129227 | A1 | 3/2002 |
| EP | 0369543 | A | 5/1990 |
| FR | 1525339 | A | 5/1968 |
| GB | 2303687 | A | 2/1997 |
| WO | 0125717 | A | 4/2001 |
| WO | 0125717 | A1 | 4/2001 |

* cited by examiner

APPARATUS AND METHOD FOR PENETRATING OILBEARING SANDY FORMATIONS, REDUCING SKIN DAMAGE AND REDUCING HYDROCARBON VISCOSITY

CROSS-REFERENCE TO RELATED APPLICATIONS

This application is a continuation of U.S. application Ser. No. 10/691,802 filed on Oct. 22, 2003.

BACKGROUND OF THE INVENTION

1. Field of the Invention

The invention relates generally to the design of shaped charges. In particular aspects, the invention relates to improved liner design for shaped charges and the use of improved shaped charges within a wellbore in order to better penetrate oil bearing sandy formations with minimal skin damage and to reduce hydrocarbon viscosity. Such a shaped charge features a composite jet that produces a large diameter hole in the formation, barely disturbing the formation properties. Such charges will greatly benefit gravel-packing completions.

2. Description of the Related Art

Shaped charges are used in wellbore perforating guns. A shaped charge typically consists of an outer housing, an explosive portion shaped as an inverted cone, and a metal liner that retains the explosive portion within the housing. When oil-bearing sands are perforated by conventional shaped charges, the full oil-producing potential of the formation is often not realized. The perforated walls tend to get cemented over by the backflow of jet material from the impacted region. During detonation of the shaped charge, a high-velocity jet is formed which is preceded by a mushroom-shaped front end and followed by a slow-moving slug of material. As the metallic jet penetrates the surrounding oil-well casing, cement sheath, and formation, portions of the casing and formation are displaced by the metallic jet and placed into plastic back flow. This results in an area around the perforation tunnel where the material that was within the tunnel has been compressed. Because the material is compressed, it is denser and less permeable than the undisturbed in-situ rock in the formation. This decrease in permeability may be sufficient to preclude hydrocarbons from entering the perforation tunnel.

In conventional shaped charges, the liner that retains the explosive charge within the housing is typically made of a single monolithic material, principally copper, but also sometimes of tungsten, brass, molybdenum, lead, nickel, tin, phosphor bronze, or some combination of these elements. Other prior liner designs have been made from sintered copper or lightly consolidated copper powder mixed with graphite and tungsten powders. These liner designs are better suited for penetration of the wellbore casing and the formation, but cause significant skin damage to the perforation tunnel and are, therefore, not optimal for use in oil-bearing formations.

The inventors of this application have recognized this. With sandy formations, the depth of the penetration is typically not of great importance to achieving good production of the well. Sandy formations have good initial permeability. Of greater significance is the cleanliness of the perforation. The high compression and ensuing plastic flow of target material damages the original permeability of the formation, thus inhibiting the free flow of hydrocarbons into the wellbore and often necessitating drastic post perforation treatment. A perforation that results in minimal skin damage will effectively permit transmission of hydrocarbons into the wellbore.

U.S. Patent Application Publication 2003/0037692 A1 by Liu discusses the use of aluminum in shaped charges. Among the several shaped charge designs discussed are those that employ aluminum either mixed with the explosive or used as a solid liner with or without the accompaniment of a copper liner for producing a deep penetrating jet. He also discusses mixing aluminum with ferrous oxide to form the liner. In Liu's design, additional energy is released through a secondary detonation when molten aluminum reacts with an oxygen carrying substance, such as water. However, Liu's application teaches mixing of inert powder aluminum with energetic explosive. This actually reduces the available energy content per unit volume of explosive, which, in turn, reduces the likelihood of aluminum undergoing the secondary detonation inside the hollow carrier gun due to the limited air space in its interior. Once the solid slug made from the aluminum liner reaches the formation, it lodges itself into the deep narrow hole made by the aluminum or copper jet that preceded it. This rapidly cooling solid slug lodged in the perforation tunnel severely restricts, if not completely stops, the flow of hydrocarbons into the well. Reaction of the aluminum slug with the borehole water will be limited to the exposed surface of the slug, at best.

The present invention addresses the problems of the prior art.

SUMMARY OF THE INVENTION

The present invention provides a shaped charge and a method of using such to provide for large and effective perforations in oil bearing sandy formations while causing minimal disturbance to the formation porosity. Shaped charges are described that use a low-density liner having a filler material that is enclosed by a polymer-resin skin, such as plastic or polyester. The filler material is in the powdered or granulated form and is left largely unconsolidated. In the preferred embodiments, the filler material is a metal powder, such as aluminum powder that is coated with a polymer or other substance, such as TEFLON®, thereby permitting a secondary reaction inside the formation following detonation. In a further described embodiment, an explosively formed penetrator (EFP) is is provided with a liner having powdered or granulated filler material.

The liner is also provided with a metal cap member for penetration of the gun scallops, intervening well fluid, and the surrounding oilwell casing and cement sheath. The metal cap member forms the leading portion of the jet, during detonation. The remaining portion of the jet is formed from the low-density, unconsolidated powder liner, thereby resulting in a more particulated jet. The jet causes little compression around the perforation tunnel and the skin damage is minimal.

In operation, a large diameter perforation hole is created by a jet of increased diameter rather than by a conventional focused jet, which is formed of a beam of particles. High target compression is avoided through the use of a low-density liner. The jet is slower and much hotter. Hotter jets better open the pores within the formation and particularly avoid the compressed area immediately surrounding the perforation tunnel. Once the filler particles reach the perforation tunnel, the fluorine atom in the TEFLON® coating oxidizes the aluminum atom under the prevailing conditions of high shock pressure and high temperature. This, in turn, releases a high amount of energy causing a secondary detonation in the perforation tunnel. Since the fluorine atom is carried by aluminum particles in the stoichometrically correct proportion, the oxidation reaction is more certain and not dependent upon the availability of water molecules, as was the case for the devices described in U.S. Patent Application Publication 2003/0037692 A1 by Liu. Even if the secondary reaction fails, the elevated temperature of the jet and TEFLON® reduces hydrocarbon viscosity. If the coating is a polymer other than TEFLON® or another oxidizing agent, the secondary detonation will not take place and the reduction of hydrocarbon viscosity will be primarily due to reduction of friction.

The present invention provides significant advantages over prior art devices and methods, such as those described in the Liu patent application. In preferred embodiments of the present invention, heating of the aluminum is more assured due to the collapse of air voids present in the unconsolidated aluminum powder. Air void collapse and high temperatures are developed locally in the vicinity of aluminum particulates when the detonation wave resulting from explosive initiation sweeps over the liner. Also, the present invention is not dependent upon aluminum particles finding water or other oxygen-carrying molecules to react with. In preferred embodiments, polytetrafluoroethylene (PTFE) or TEFLON®, a very powerful oxidizer carrying a large number of fluorine atoms, is coated onto the aluminum particles.

BRIEF DESCRIPTION OF THE DRAWINGS

For greater understanding of the invention, reference is made to the following detailed description of the preferred embodiments, taken in conjunction with the accompanying drawings in which reference characters designate like or similar elements throughout the several figures of the drawings.

DETAILED DESCRIPTION OF THE PREFERRED EMBODIMENTS

Figure 1:
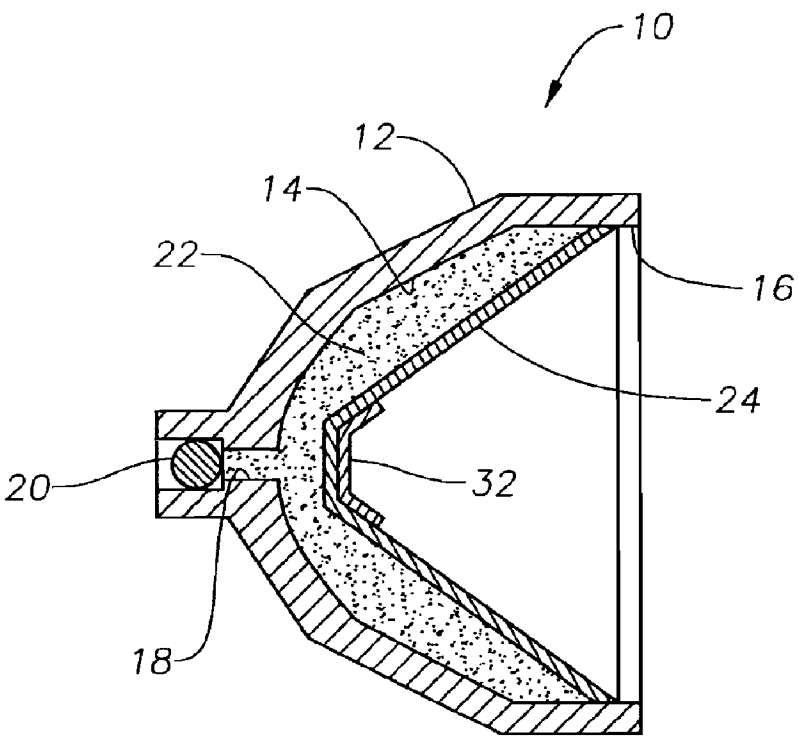
FIG. 1 is a side, cross-sectional view of an exemplary shaped charge constructed in accordance with the present invention.

FIG. 1 illustrates an exemplary shaped charge 10 that is constructed in accordance with the present invention. The shaped charge 10 includes an outer charge casing, or case, 12 that is typically fashioned of metal. The casing 12 defines a charge cavity 14 that is generally hemispherical and presents an open forward end 16. At the rear end of the casing 12, a small aperture 18 is disposed. A small amount of booster is usually placed in the aperture 18. A detonator 20 is retained adjacent to the aperture 18. The detonator 20 typically comprises a detonation cord, or other items known in the art for initiation of a shaped charge. An explosive charge 22 is disposed within the charge cavity 14 and within the forward portion of the aperture 18 so as to be in contact with the booster which is, in turn, in contact with or in close proximity with the detonator 20. The explosive material may comprise RDX (Hexogen, Cyclotrimethylenetrinitramine), HMX (Octogen, Cyclotetramethylenetetranitramine), HNS, PYX or other suitable high explosives known in the industry for use in downhole shaped charges. A liner 24 seals the material of the explosive charge within the charge cavity 14. The liner 24 may assume any suitable shape, including hemispherical, trumpet, tulip, bell, and conical (shown).

Figure 2:
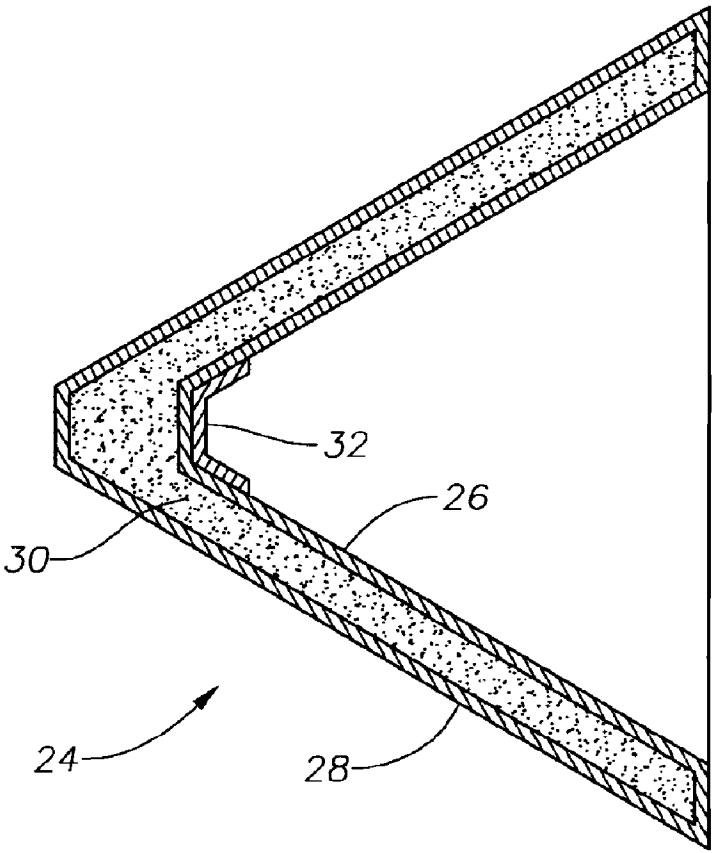
FIG. 2 is a cross-sectional view of an exemplary shaped charge liner shown apart from other components.

The structure of the liner 24 is better appreciated with reference to FIG. 2. As seen there, the liner 24 includes a pair of outer membranes 26 and 28 that sandwich a low-density filler material 30 therebetween so as to provide a double-walled configuration. The outer membranes 26 and 28 are preferably made of a substantially contiguous polymer-resin skin, such as plastic or polyester material that is lightweight. Alternatively, the outer membranes 26, 28 may be formed of a thin sheet of metal, such as copper. It is preferred that the membranes 26 and 28 be affixed to one another in a contiguous manner so as to completely enclose the filler material 30. In other words, the outer membranes 26 and 28 would completely encapsulate the filler material 30.

The filler material 30 is a granulated or powdered and preferably largely unconsolidated. In preferred embodiments, the filler material 30 comprises a micro-sized or nano-sized metal powder, most preferably aluminum powder. Aluminum is a preferred filler material since it is highly reactive during detonation and releases explosive power in the presence of an oxidizer. Aluminum burns hot and releases significant amounts of thermal energy during the course of the detonation and perforation of a wellbore. Alternatively, the filler material 30 may comprise aluminum powder intermixed with a polymer powder, such as TEFLON®. In a particularly preferred embodiment, the filler material 30 comprises a polymer-coated metal powder, such as aluminum powder coated with TEFLON® polymer. This combination of substances is particularly desirable since it provides for secondary "special effects" during perforation and after detonation. Specifically, the TEFLON® passivates the highly reactive aluminum powder during manufacturing and storage and permits controlled oxidation of the aluminum particles when initiated. Additionally, the fluorine in TEFLON® feeds the oxidation reaction in an oxygen-poor downhole environment and typically contributes to a secondary detonation inside the formation following jet penetration. In case the secondary reaction fails, the hot-burning aluminum opens the pores within the formation surrounding the perforation, thereby providing for better flow of hydrocarbons into the perforation tunnel and the wellbore. This increases the perforation temperature and reduces interstitial fluid viscosity. Unreacted TEFLON® advantageously reduces in situ hydrocarbon viscosity as well.

In an alternative embodiment, the filler material 30 might also comprise a metal powder coated with another metal, for example, tungsten powder coated with copper. Alternatively, the filler material 30 might be made up of hollow metal pellets or micro-balloons of metal or glass.

As noted, the filler material 30 is largely unconsolidated and is not compressed or sintered together. In the preferred embodiments, the density of the filler material 30 within the liner 24 is close to the formation density. As a practical matter, the density of the filler material is preferably below 2.7 g/cc, or the approximate density of solid aluminum. Uniformity in filling of the liner 24 with the filler material 30 is preferably achieved by vibration of the liner 24 during filling, depending upon the mass and particle size of the filler material 30.

Figure 5:
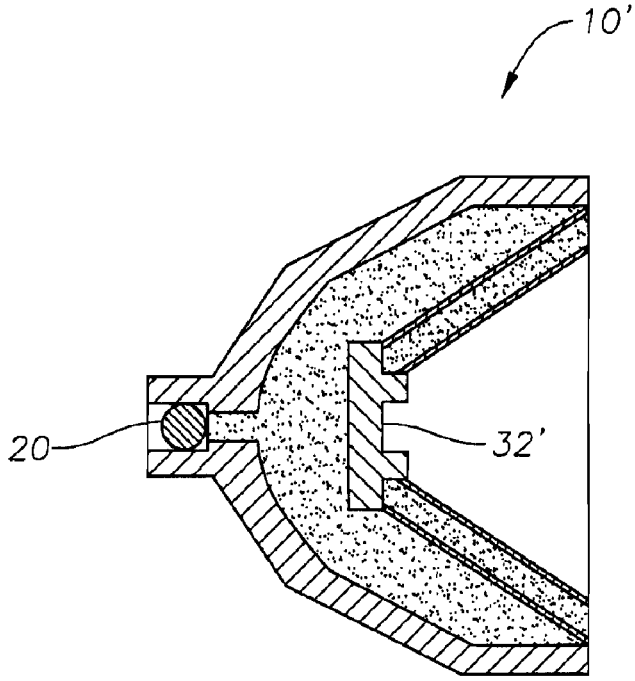
FIG. 5 is a side, cross-sectional view of an alternative exemplary shaped charge having an inset metal cap member.

A metal cap member 32 is affixed to the first membrane 26 of the liner 24 in the apex region of the casing 12. If the filled liner 24 is hemispherical in shape, then the metal cap 32 will also be a cap of sphere and reside in the polar region of the filled liner 24. The metal cap 32, in general, is conformed to the shape of the liner 24, whatever shape the liner 24 may be. The metal cap 32 is fashioned from a suitable metal material, including copper, brass, bronze, tungsten, or tantalum. FIG. 5 illustrates an alternative design for a shaped charge 10' wherein the metal cap member 32' is inset within the liner 24. In practice, this design may have advantages for security of the cap by ensuring that the cap member 32' is largely located inside of the liner 24 and is less likely in some situations to be prematurely unseated from the liner 24 prior to detonation.

Figure 3:
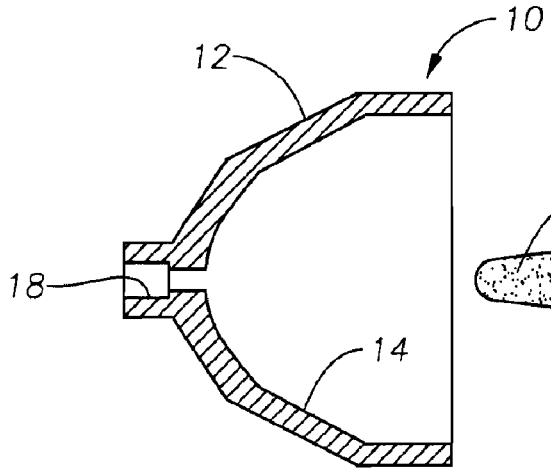
FIG. 3 is a side, cross-sectional view depicting the creation of a high velocity jet and following slug resulting from detonation of the shaped charge depicted in FIG. 1.

FIG. 3 illustrates the shaped charge 10 following detonation. The radially inner portion of the liner 24 primarily forms a forward-penetrating jet 34 while the radially outer portions of the liner 24 primarily form the slow-moving slug 36 that follows. It is noted that the leading portion 38 of the main jet 34 has a greater radial diameter than that created by most conventional shaped charges. The metal cap 32 makes a jet, which has sufficient density and mass to penetrate the casing of the wellbore and any gun scallops or protective cover that surrounds the perforating gun, provides the forward portion 38 of the jet 34. The uncollapsed portion of the liner 24 separates the main jet from the slug. The use of low-density, unconsolidated filler material 30 in the liner 24 causes the remaining portions of the jet 34 and the slug 36 to be more particulated than the corresponding conventional jets and slugs formed of tungsten, copper and similar solids or heavier materials.

Figure 4:
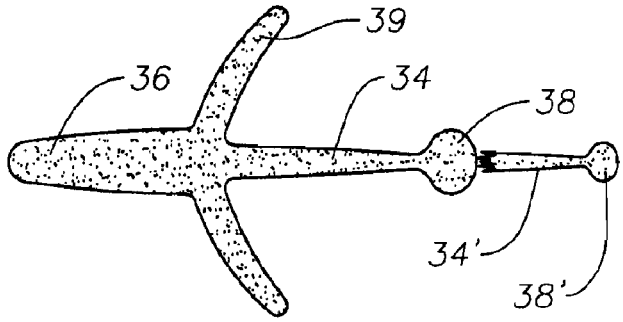
FIG. 4 is a side, cross-sectional illustration of an exemplary perforation process in accordance with the present invention.
Figure 4:
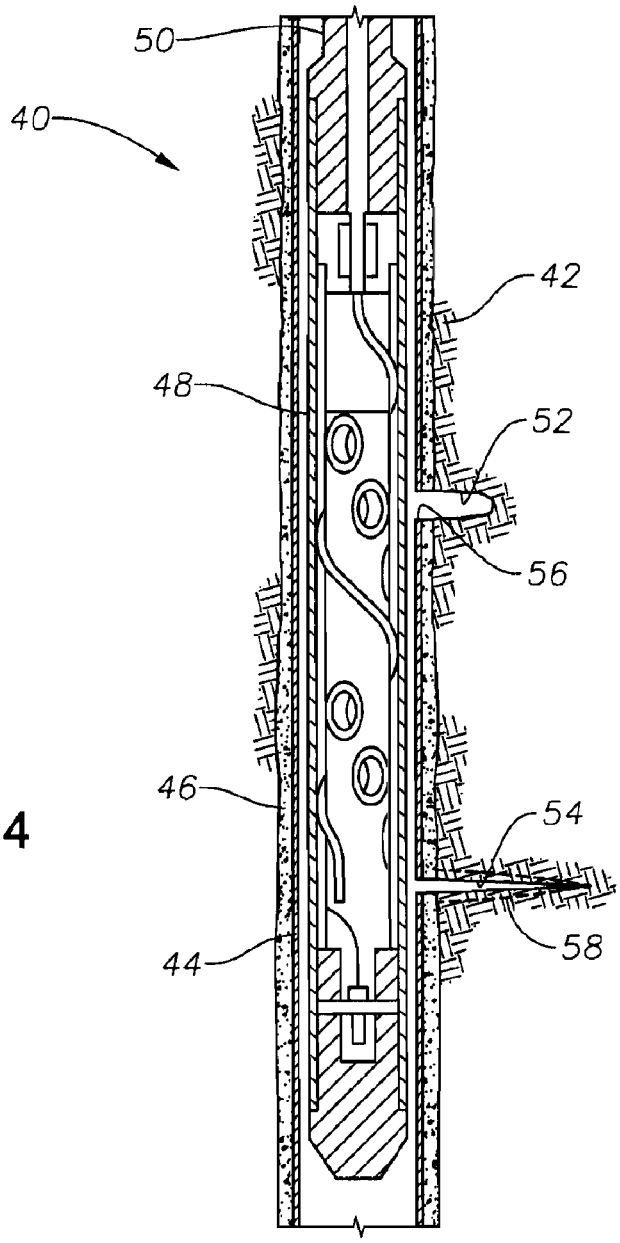

FIG. 4 illustrates an exemplary perforation process utilizing a shaped charge constructed in accordance with the present invention. Wellbore 40 is shown disposed through a sandy oil-bearing formation 42. The wellbore 40 has casing 44 that is retained by cement 46. A perforating gun 48 is shown disposed within the wellbore 40 by the tubing string 50. The perforating gun 48 may be of any of a number of types used in the industry, but includes at least one shaped charge 10, of the type described earlier. The shaped charge 10 is shown to have created a perforation 52 through the casing 44, cement 46 and formation 42. For comparison, a standard perforation 54 is also shown in FIG. 4. The skin damage resulting from a conventional jet is shown generally at 56 in FIG. 4. There will also be less compression damage to the formation 42 surrounding the perforation 52. A compression zone 58 is illustrated about the standard perforation 54 wherein the formation material has been compressed into a state that is less porous and denser. The perforation 52 is also of greater diameter than the perforation 54 and is not as deep. As noted, where the filler material 30 is composed of TEFLON®-coated aluminum powder, the jet 34 and slug 36 will tend to provide a secondary explosion within the formation which will release a lot of heat, which in turn, will increase porosity and reduce viscosity of fluids within the formation.

A shaped charge constructed in the manner described above also provides an advantage when used in sandy formations with respect to shock, or acoustic, impedance matching of the formation. The shock impedance provided by the more highly particulated jet 34 and slug 36 more closely matches the shock impedance of a sandy formation. As a result, there is a decreased amount of shear damage and skin damage to the surrounding formation.

Figure 6:
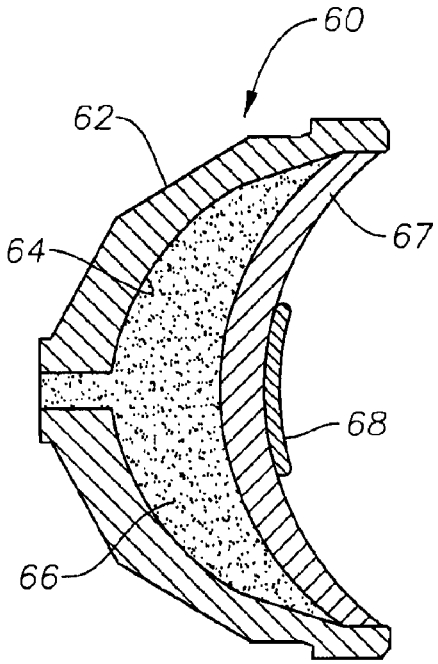
FIG. 6 is a side, cross-sectional view of an exemplary explosively formed penetrator (EFP) constructed in accordance with the present invention.
Figure 7:
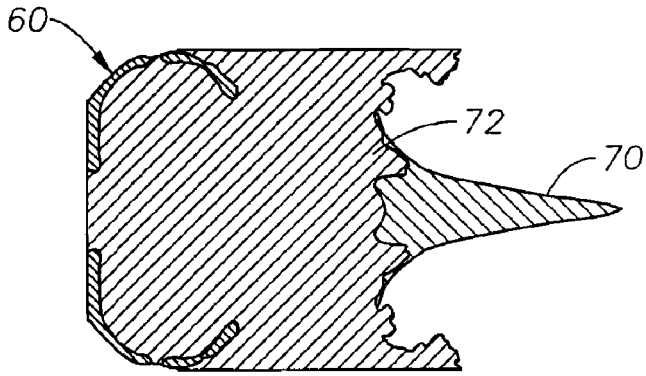
FIG. 7 depicts the EFP shown in FIG. 6 following detonation.

Referring now to FIGS. 6-7 there is shown an explosively formed penetrator (EFP) charge 60 that is constructed in accordance with the present invention. The EFP 60 is a type of shaped charge. As can be seen, the EFP is roughly hemispherical in shape and includes an outer charge case 62 that defines an interior charge cavity 64. Explosive material 65, such as RDX, is molded into the cavity 64 and conforms to the interior walls of the cavity 64. A liner 66 encloses the explosive material 65 within the cavity 64 and is conformal with the walls of the cavity 64. The liner 66 is formed of particulated filler materials, as described earlier, encased within an outer membrane (not shown) of plastic or metal, as described previously. A metal cap member 68 is affixed to the central area of the liner 64 in a polar location, as shown. In a preferred embodiment, the metal cap member 68 is formed of copper.

FIG. 7 illustrates the EFP 60 following detonation and illustrates the formation of a particulated jet 70 and following slug, or more solid jet, 72 thereby. As the detonation progresses, the formation will be penetrated by the particulated jet 70 to form a perforation. The formation will then be "kissed" by the following slug or solid jet 72. The term "kissed," as used herein, means to impact upon the surface of the formation while substantially not penetrating it and substantially not destroying the formation's porosity or permeability. Following this, a secondary detonation reaction will occur within the formation as the filler material, preferably aluminum, reacts with fluorine atoms in the formation water and, if present, TEFLON® in the filler material.

Generally speaking, the present invention improves upon several aspects of the prior art, including the Liu patent application by providing the following results or advantages:

1) aluminum reaches a high temperature during and following detonation. This is accomplished by making the liner from unconsolidated powder that carries many air pockets.
2) aluminum reacts with oxidizer to create a secondary detonation. This is accomplished by coating the aluminum particles with fluorine-carrying TEFLON®. Fluorine reactivity with aluminum is always higher than that of oxygen.
3) Aluminum delivers substantially all of its secondary detonation energy inside the perforation tunnel and not outside in the borehole or the hollow carrier gun.
4) The resulting aluminum slug cannot block the hydrocarbon flow. This is facilitated by use of unconsolidated aluminum particles in the liner that, upon explosive action, produces a particulated slug.

Those of skill in the art of shaped charges will recognize that numerous modifications and changes can be made to the illustrative designs and embodiments described herein and that the invention is limited only by the claims that follow and any equivalents thereof.

What is claimed is:

1. A shaped charge comprising:
a charge case;
an explosive charge;
a liner for retaining the explosive charge within the case, the liner having an apex and comprising:
a substantially contiguous first liner membrane;
a substantially contiguous second liner membrane; and
a particulated filler material disposed between the first and second liner membranes, which is substantially unconsolidated; and
a cap disposed upon the liner, the cap being inset within the liner at the apex.

2. A shaped charge of claim 1, wherein the cap is in physical communication with the first liner membrane, the second liner membrane, and the particulated filler material.

3. A shaped charge of claim 1, the cap being comprised of metal.

4. A shaped charge of claim 3, wherein the metal includes one or more of copper, brass, bronze, tungsten, and tantalum.

5. A shaped charge of claim 1, wherein the particulated filler material is comprised of:

micro-sized or nano-sized metal powder; and a polymer powder.

6. A shaped charge of claim 5, wherein the metal powder includes aluminum.

7. A shaped charge of claim 5, wherein the polymer powder includes TEFLON.

8. A shaped charge of claim 1, wherein the particulated filler material is unconsolidated.

9. A shaped charge of claim 1, wherein the particulated filler material comprises micro-sized or nano-sized metal powder coated with a different metal.

10. A shaped charge of claim 1, wherein the particulated filler material comprises at least one of:

hollow metal pellets;

micro-balloons of metal; and micro-balloons of glass.

11. A shaped charge of claim 1, wherein the particulated filler material has a density below 2.7 g/cc.

* * * * *